United States Patent [19]

Eller et al.

[11] 4,263,746

[45] Apr. 28, 1981

[54] REVERSING CIRCUIT FOR A POWERED CLOSURE

[76] Inventors: Harry J. Eller, 216 Birch Hill Dr., Rochester, Mich. 48063; Donald G. Eller, 39336 Farmhill Dr., Sterling Heights, Mich. 48078; Edward R. Dudek, 31465 Beechwood, Warren, Mich. 48093

[21] Appl. No.: 57,522

[22] Filed: Jul. 13, 1979

[51] Int. Cl.[3] ..... E05F 15/02

[52] U.S. Cl. ..... 49/28; 91/435

[58] Field of Search ..... 49/28, 26, 264; 91/435

[56] References Cited

U.S. PATENT DOCUMENTS

| | | | |
|---|---|---|---|
| 2,426,692 | 9/1947 | Katz | 91/435 |
| 3,276,164 | 10/1966 | Hilfing et al. | 49/28 |
| 3,727,348 | 4/1973 | Steinmann et al. | 49/28 |
| 3,864,875 | 2/1975 | Hewitt | 49/264 |
| 3,916,567 | 11/1975 | Daugirdas | 49/28 |
| 3,938,282 | 2/1976 | Goyal | 49/264 X |
| 4,057,934 | 11/1977 | Okubo et al. | 49/28 |

*Primary Examiner*—Philip C. Kannan

*Attorney, Agent, or Firm*—Krass, Young & Schivley

[57] ABSTRACT

A safety reverse arrangement is disclosed for reversing the direction of the powered operation of a door upon encountering an obstacle during its opening and closing movement. The arrangement includes a piston fit within a vented cylinder, which is stroked by the opening and closing movement of the door, while a pair of air flow detector switches receive the resulting air outflow developed during stroking of the piston. The air flow detector switches are integrated with a control circuit for the door powering arrangement such that, after an initial short delay period, any interruption in the flow to the flow detector results in a reversing of the direction of the door movement. Such interruption of air flow occurs upon the door encountering an obstacle during its opening or closing movement.

15 Claims, 3 Drawing Figures

REVERSING CIRCUIT FOR A POWERED CLOSURE

BACKGROUND DISCUSSION

It is often desirable to incorporate safety controls in powered closures such as building door operators such that in the event the door encounters an obstacle during its opening or closing movement, the powered operation is either discontinued or the direction of drive to the door is reversed, so as to avoid a jam condition which may cause injury to persons or damage to the door or other equipment. Such devices have heretofore been provided which mechanically sense a jam condition and are commonly employed in applications as garage door operators.

Such arrangements are satisfactory for relatively lightweight door structures as are normally incorporated as garage doors. However, such powered operation is sometimes utilized in connection with relatively massive door closures. One such application is for sealed doors for testing enclosures in which a relatively heavy door is cantileved to be moved overhead between an open and closed position. In the closed position, the door is sealed with respect to the closure structure as by an air pressure sealing arrangement. The sealing of the door precludes the rolling track motion of typical garage doors and requires a simple hinging about an overhead horizontal hinge axis, which requires considerably more power to operate due to the cantilevering of the entire door weight. The relative mass of the door and the overhang mounting of the door reqires considerable operating power, and any dependence on simple mechanical detection of an overload condition in the door drive may not react rapidly enough to avoid the injury or equipment damage sought to be eliminated by the safety circuits.

Furthermore, the above-mentioned mechanical jam detectors require the development of a jam condition in which a reaction force is impressed on the obstacle. Such forces may be moderate for the applications described but would be excessive for many other applications.

Accordingly, it is an object of the present invention to provide a safety circuit arrangement for a power closure operator in which very rapid reaction of the safety reversal is achieved prior to the development of any significant load in the drive system such as to avoid injury or damage even for such door operating systems involving substantial momentum of the door and high operating forces exerted during its opening and closing movement.

It is yet another object of the present invention to provide such a reversing arrangement which is simple and yet highly reliable in operation and which is very sensitive to the development of interruption in motion of the door during opening or closing movement.

SUMMARY OF THE INVENTION

These and other objects of the present invention, which will become apparent upon a reading of the following specification and claims, are achieved by a reversing arrangement for a powered closure which includes a fluid motor operated by opening and closing movement of the closure to generate an air flow through a pair of respective air flow detector assemblies, each corresponding respectively to the opening or closing movement. The disclosed fluid motor is comprised of a piston and cylinder, with the piston stroked in the cylinder by the opening and closing movement of the closure.

Each of the air flow assemblies includes an air flow switch which is integrated into the control circuit for the door operating control, such that after an initial delay period, the interruption of flow through the respective flow detector switch results in a reversal of the control circuit to thereby discontinue advance and reverse direction of the door opening movement. This enables the detection of an obstacle and execution of the reversal of motion prior to the development of any significant loading in the drive system, to thus avoid the imposition of significant stresses on the drive system or on the obstacle to door motion.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figures 1, 3:
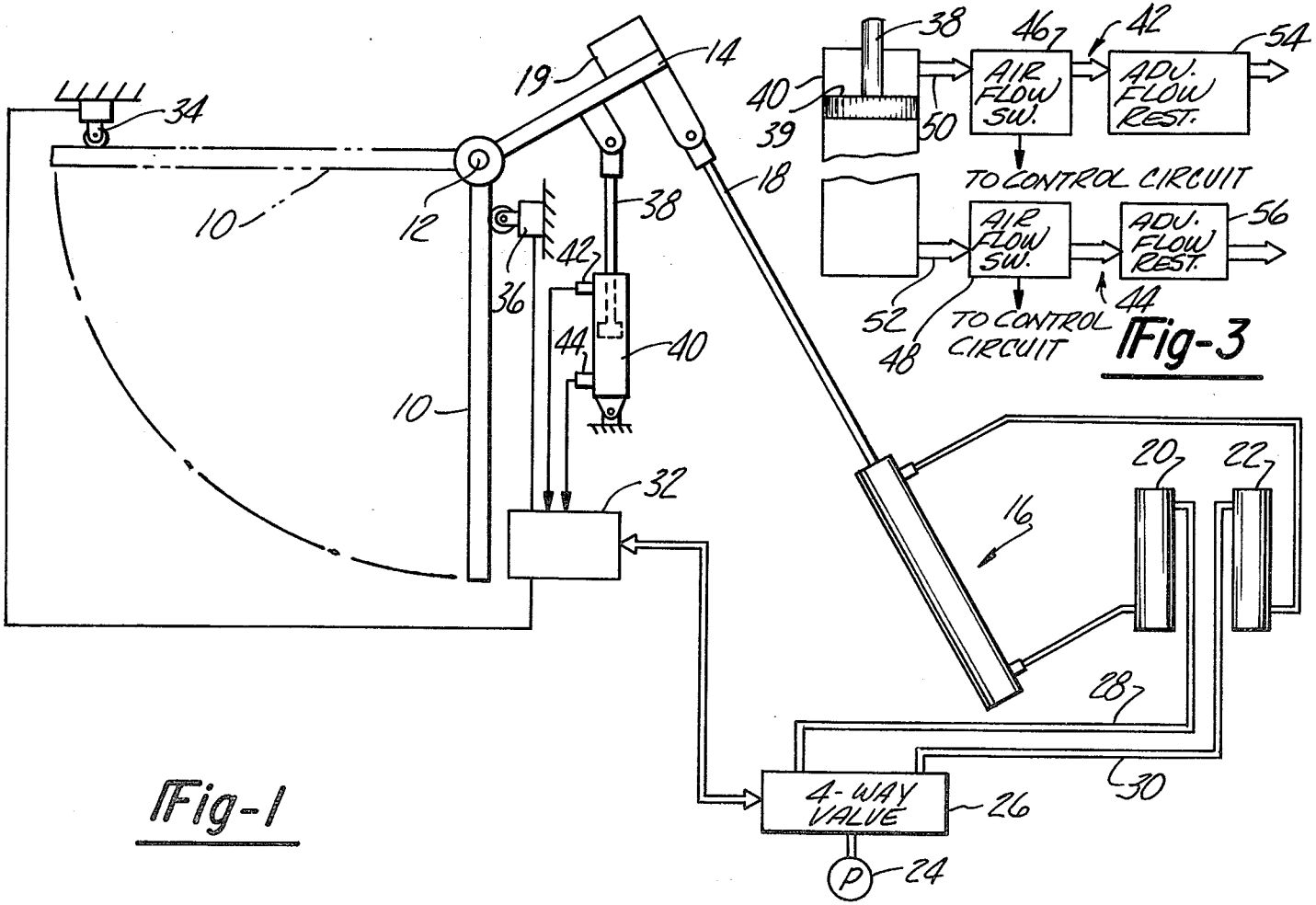
FIG. 1 is a diagrammatic representation of the door and operating system including the reversal arrangement according to the present invention.
FIG. 3 is a diagrammatic representation of the installation of the flow detector assemblies.

Referring to FIG. 1, a diagrammatic representation of a powered closure is depicted consisting of a cantilevered door 10 mounted for pivoting movement about a horizontal hinge axis 12 between open and closed positions. The closed position is shown as in the vertical disposition of the door 10 and the open position is rotated about the hinge axis 12 to a substantially horizontal position of the door 10.

The door 10 is powered by means of a fluid pressure actuator drivingly connected to an operating lever 14 fixed to the door 10 and extending outwardly from the hinge axis 12. The fluid pressure actuator 16 here takes the form of a piston and cylinder having an operating rod 18 secured to the operating lever 14.

A counterweight 19 may also be included which is mounted to create an opening movement on the operating lever 14 tending to counterbalance the weight of the door 10.

The fluid actuator 16 preferably consists of a hydraulic-pneumatic system at which air pressure is utilized and which the cushioning effect of the hydraulic system is incorporated. This is by means of a pair of air oil cylinders 20 and 22 which in turn are pressurized by compressed air received from a compressed air source 24 and with a four-way valve 26 controlling communication via lines 28 and 30 of either air oil cylinder 20 or 22.

The respective air oil cylinders 20 and 22 cause either up or down movement of the door 10 if the air oil cylinder 20 is pressurized via line 28, the operating rod 18 is extended from the fluid actuator 16. If the air oil cylinder 22 is pressurized, the resultant pressure position of the fluid actuator 16 causes retraction of the operating rod 18 and opening movement of the door 10.

Use of the air oil cylinders 20 and 22 interposed with the air source 24 allows the relatively smooth controlled motion of a hydraulic actuator while at the same time enabling the use of simple air pressure which is readily available in most factory installations, without necessitating the provision of a hydraulic power pack unit.

The four-way valve 26 is controlled by the control circuitry indicated generally at 32 which is operated by manually controlled switching as well as electrical signals received from various sensors included in the control arrangement. These include an up-limit switch 34 which contacts the door 10 in the full open or up position, as well as a downlimit switch 36 which is operated as the door 10 comes into the full closed or down position. In addition, there is also provided a means for detecting the motion of the door either towards the open or closed position which means generates a signal upon any interruption in that motion. This means includes means for producing a fluid flow in response to the up and down motion, which fluid flow ceases immediately upon any interruption or hesitation in the door motion.

This means (FIG. 1) takes the form of a fluid motor comprised of a piston and cylinder combination, with the piston 39 connected to an extension rod 38, in turn secured to the operating lever 14 thereby stroking the piston by the movement of the door 10 to either the open or closed position.

The piston 39 is stroked within the cylinder 40 such as to produce a pumping action either above or below the piston 39 depending on the direction of movement.

The interior space within the cylinder 40 is in communication with a pair of flow detector assemblies 42 and 44 which have an internal passage which is in communication with the interior space such as to receive fluid flow generated either above or below the piston 39 as the extension rod 38 is extended or retracted.

The flow detector assemblies 42 and 44 both include air flow switches indicated at 46 and 48, respectively, associated with fluid flow passages 50 and 52, respectively, in communication with the upper and lower regions of the cylinder 40 on either side of the piston 39 which are vented to expel air during the motion of the piston 39 towards a respective fluid flow passage 50 or 52. The air flowing through fluid flow passages 50 and 52 flows through the respective air flow switch 46 or 48 which are responsive to a predetermined low flow level to close an electrical switch which is integrated into the control circuitry 32, as will be described hereinafter in detail.

The reopening of the respective air flow switches 46 and 48 during opening or closing movement of the door 10 causes a reversal of the direction of stroking of the fluid actuator 16. This reopening is caused by the decline of air flow in the fluid flow passages 50 or 52 below the predetermined level to which the air flow switches are responsive, in turn brought about by the slight hesitation in the door movement upon encountering an obstacle during its opening or closing movement.

Adjustable flow restrictions 54 and 56 are also provided in which the vent flow occurring through the fluid flow passages 50 and 52 is limited to be just above the triggering range of the air flow switches 46 and 48, while not set so low as to appreciably impede the motion of the door 10. This produces a calibrated flow rate for the given travel speed of the door 10 as it is being powered by the fluid actuator 16.

This control over the vent flow enables the air flow switches 46 or 48 to respond immediately upon a slight drop in vent flow, in order to reverse the door drive upon the slightest hesitation in the door movement.

There is a delay means built into the control circuitry 32 such as to not produce the reversal for a slight delay interval at the initiation of each opening and closing cycle. This is so the motion of the door may get under way and flow through the fluid flow passages 52 can be initiated. This delay is very slight, on the order of a very few seconds, such that only slight movement will take place before the safety circuit is operational, and the possibility of forcible encountering with an obstacle is therefore negligible.

The air flow switches 46 and 48 are of a known type currently commercially available and basically consist of a vane positioned within the air flow stream which responds to a given rate of air flow to close the switch contacts, and reopen the same when the air flow declines below the preset or adjusted air flow rate.

A suitable commercial air flow switch is the Pacer Mode SF-5PVD-NO.

Figure 2:
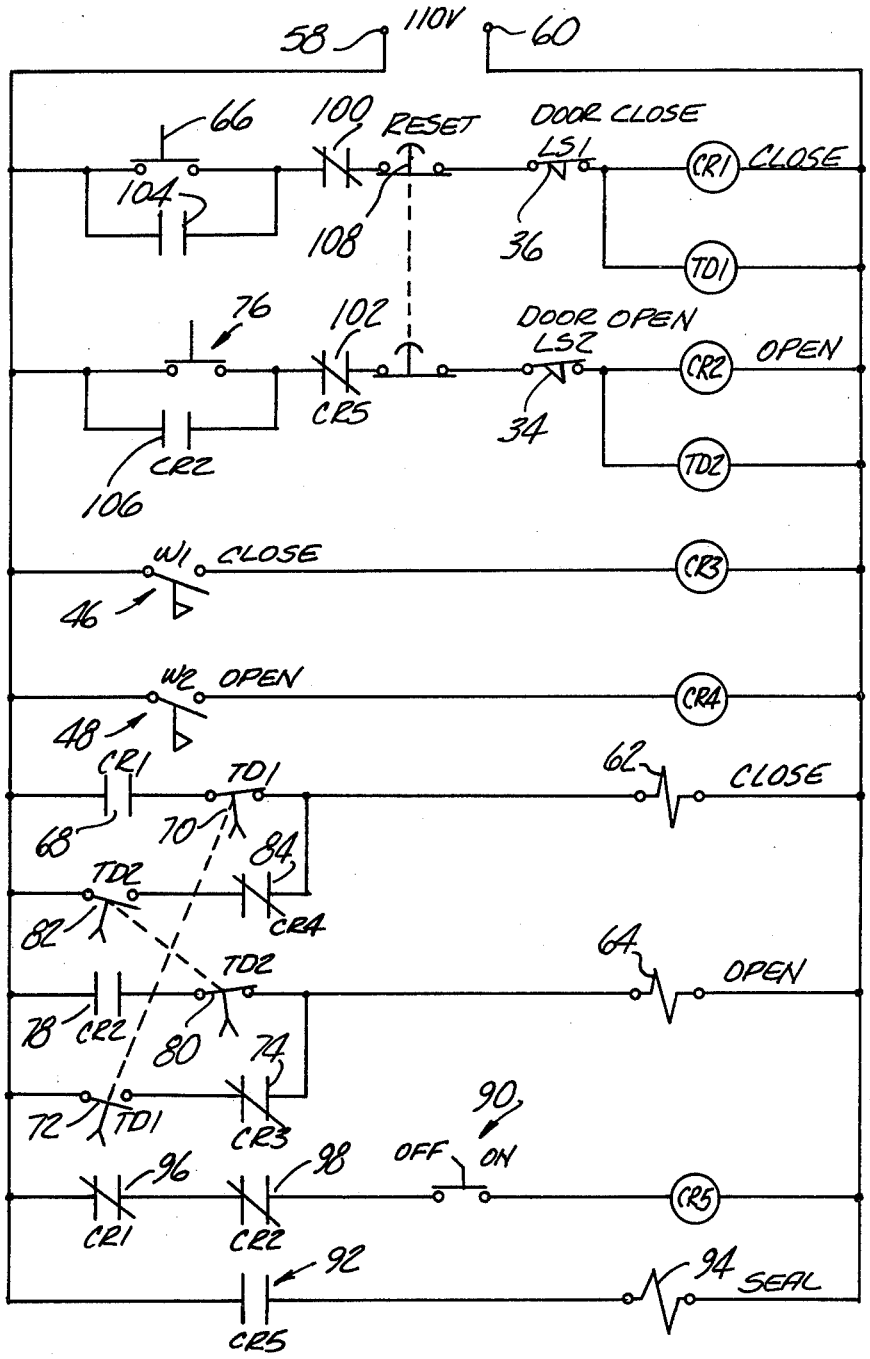
FIG. 2 is a schematic diagram of the control circuit incorporated in the system depicted in FIG. 1.

According to the circuit diagram of FIG. 2, the input terminals 58 and 60 have applied thereto line voltage, which provides the electrical power to operate the four-way valve solenoids 62 and 64, as indicated schematically. The energization of the valve solenoids 62 and 64 causes the four-way valve 26 to pressurize either air oil cylinder 20 or 22, respectively, and produce either closing or opening movement of the door 10.

The door close control switch 66 energizes the closing relay CR1 as well as the time delay relay TD1. This pulls the CR1 contact 68 and TD1 contact 70 which energizes the valve solenoid 62 and causes the closing actuation of the fluid actuator 16.

After the time delay relay TD1 times out, the first relay contact set 70 which has enabled energization of the valve solenoid 62, is opened and at the same time interconnected contact set 72 closed. This thus interrupts the circuit to the valve solenoid 62 and sets up a reversing circuit to reverse the direction of the valve solenoid 64 via contact set 72. However, the contact set 74 of relay CR3 is normally closed and is opened only upon energization of relay CR3.

The relay CR3 in turn is energized by the air flow switch 46 which is closed as long as the predetermined minimum air flow in fluid flow passage 50 is present which in turn maintains the reversing circuit deenergized.

The deenergization of the close valve solenoid 62 does not produce a change in the valve position since a detented four-way design is utilized, i.e., once the four-way valve 26 has been shifted to a position establishing communication with the air pressure with one or the other of the air oil cylinders 20 or 22, a change in position will not occur unless the reverse solenoid is energized.

Accordingly, the door continues to move to the closed position and fluid actuator 16 remains pressurized, forcing the door against the door frame in the full closed position. After reaching the full closed position, down-limit switch 36 opens and deenergizes relays CR1 and TD1.

In the event the closing movement of the door is interrupted even very slightly, the air flow switch 46 will open, deenergizing relay CR3 which allows the contact set 74 to close and energize, via contact set 72 of time delay relay TD1, the opening solenoid 64 in turn shifts the four-way valve to a reversing movement of the door 10, i.e., to be moved towards the full open position.

In similar fashion, the open control switch 76 controls energization of the relay CR2 and time delay relay TD2 which in turn produces energization of the open valve solenoid 64 and movement of the four-way valve 26 so as to pressurize the fluid actuator 16 in a direction to produce opening movement of the door 10. This is by closing of contact set 78 of the relay CR2 and the contact set 80 of the time delay relay TD2 during the initial time delay period. After the time delay relay TD2 times out, the contact set 80 is opened while the reversing contact set 82 is closed, setting up the reversing circuit via the contact set 84 associated with the relay CR4. Relay CR4 in turn is energized by closing of the air flow switch 48.

Thus, after energization of relays CR2 and TD2, the opening valve solenoid 64 is energized, moving the four-way valve 26 to pressurize the fluid actuator 16 in a direction to cause opening movement of the door 10. The position of the four-way valve 26 continues after opening of the contact set 80 of the time delay relay TD2 due to the detented design of the four-way valve 26.

The closing of the air flow switch 48 opens the contact set 84 such that as long as the minimum air flow is present in fluid flow passage 52, a reversing circuit will not produce energization of the close valve solenoid 62. If the door 10 encounters an obstacle or other reason for producing a hesitation in its motion, the reduction of air flow in fluid flow passage 52 will produce opening of the air flow switch 48, deenergization of the relay CR4 and closing of the contact set 84, producing energization of the close valve solenoid 62 and reversal of the door motion.

In the event such obstacle is not encountered, the door continues to move to the open position until the up-limit switch 34 is opened, deenergizing relay CR4 and TD2 to prepare for another cycle.

As indicated above, the arrangement is contemplated for use in connection with a sealed door in which an inflatable bladder-type seal is utilized and the control of the same is indicated in the circuit diagram of FIG. 3.

An on/off switch 90 enables energization of the relay CR5 with a contact set 92 energizing a seal solenoid 94. A set of normally closed contacts 96 and 98 associated with the respective relays CR1 and CR2 prevent energization of the relay CR5 if either of the relays CR1 or CR2 are energized.

Thus, only in the full open or full closed position of the door 10 is the energization of the CR5 relay possible and inflation of this seal.

Similarly, normally closed contacts 100 and 102 are interposed in the lines for the respective relays CR1 and CR2 to preclude energization of the relays so long as the seal solenoid CR5 is energized. Each of the opening and closing switches 76 and 66 have relay contacts 104 and 106, respectively, associated therewith. Also, a reset switch 108 is provided to provide deenergization of the relays CR1, TD1, CR2 and TD2.

Accordingly, it can be appreciated that a reversing safety arrangement according to the present invention achieves the above-recited objects in that the reversal does not require a build-up of forces in the drive system such as to impose a significant stress on the components or on whatever is causing an obstacle. All that is required to trigger the reversal is the slightest hesitation in the advancing movement of the door during its opening and closing motion such that the lightest touch will rapidly bring about the safety reverse.

At the same time, the arrangement does not require the use of delicate and unreliable sensing components and is highly reliable in operation, and does not require the use of complex and costly controls inasmuch as the control circuitry utilized is commercially available, with standard valving and cylinders.

The embodiments of the invention in which an exclusive property or privilege is claimed are defined as follows:

1. An arrangement for discontinuing the movement of a member mounted for powered motion, said arrangement comprising:

means for generating a fluid flow by said motion of said powered member;

fluid flow detector means for detecting the fluid flow created by said motion of said powered member and including means generating signals corresponding to variations in said fluid flow; and, control means responsive to said signals generated by said fluid flow detector means discontinuing said advancing motion of said powered member upon the occurrence of a predetermined variation in said fluid flow and generation of a corresponding signal by said fluid flow detector means.

2. The arrangement according to claim 1 wherein said powered member is further mounted for reverse movement along opposite directions of motion and wherein said control circuit means further includes reversing circuit means causing reversing of said powered motion of said member upon occurrence of said predetermined variation in said fluid flow detected by said fluid flow detector means.

3. The arrangement according to claim 2 wherein said fluid flow detector means includes a piston and cylinder and means drivingly connecting said piston and cylinder with said powered member producing reciprocation of said piston in said cylinder by said powered motion of said member and further including passage means receiving fluid flow out of said cylinder caused by relative motion of said piston in said cylinder.

4. The arrangement according to claim 2 wherein said arrangement further includes fluid flow means producing fluid flow by said powered motion of said member in said reverse direction and further including fluid flow detector means detecting said fluid flow generated by said reverse motion of said powered member and generating corresponding signals upon the occurrence of predetermined variations in said flow and wherein said control means further includes means producing reversal of said powered motion from said reverse direction of said powered motion to said first direction of motion of said powered member, whereby said reversing motion is generated upon variations in fluid flow corresponding to variations in said motion of said powered structure in either of said directions of motion.

5. The arrangement according to claim 4 wherein said means producing fluid flow in said first and reverse directions of said motion of said member comprises a piston and cylinder and means drivingly connecting said piston and cylinder to said member to produce reciprocation of said piston in said cylinder by motion of said member and further including fluid flow passage means extending in communication with the interior of said cylinder on either side of said piston, and means